US005119520A

United States Patent [19]

Finn

[11] Patent Number: 5,119,520

[45] Date of Patent: Jun. 9, 1992

[54] COMBINATION HAND TOOL WITH SPRING-LOADED LOCKING DEVICE

[76] Inventor: Patrick W. Finn, 2526 - 5th Ave., North Riverside, Ill. 60546

[21] Appl. No.: 581,667

[22] Filed: Sep. 13, 1990

[51] Int. Cl.[5] ..... B25B 7/22

[52] U.S. Cl. ..... 7/127; 81/319; 81/326; 81/426.5

[58] Field of Search ..... 7/125, 127; 81/177.7, 81/177.8, 177.9, 318, 319, 324, 325, 328, 418, 426.5

[56] References Cited

U.S. PATENT DOCUMENTS 512,086 1/1894 Ashcraft ..... 87/324
2,249,661 7/1941 Littlefield ..... 87/328
2,514,598 7/1950 Douglas ..... 87/177.9 X
3,946,453 3/1976 Torres ..... 7/127
4,920,593 5/1990 Finn ..... 7/127

*Primary Examiner*—James G. Smith
*Attorney, Agent, or Firm*—Mathew R. P. Perrone, Jr.

[57] ABSTRACT

A pair of pliers has a tool mounted to each arm end, such as, for example, a screwdriver tip at one end of each handle, a nail puller in the jaws of the pliers and a spring-loaded, slip joint-activated locking mechanism to hold the jaws in a predetermined position by operation of the slip joint, with an optional socket receiving tip on the pliers.

11 Claims, 4 Drawing Sheets

FIG. 8
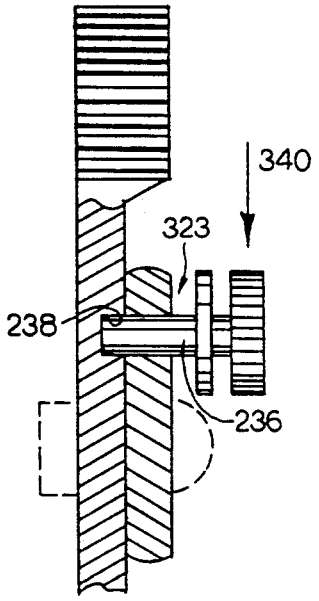
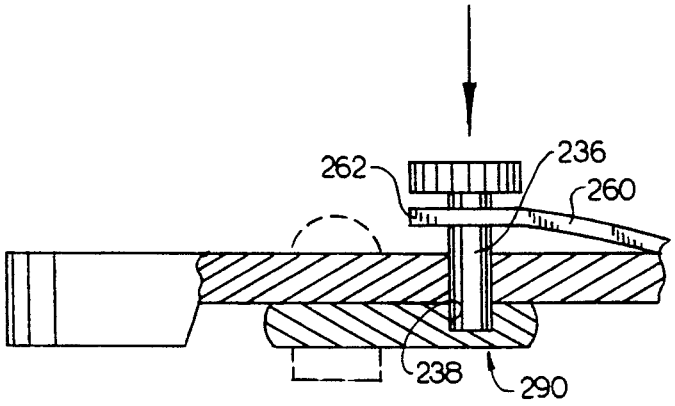
FIG. 9
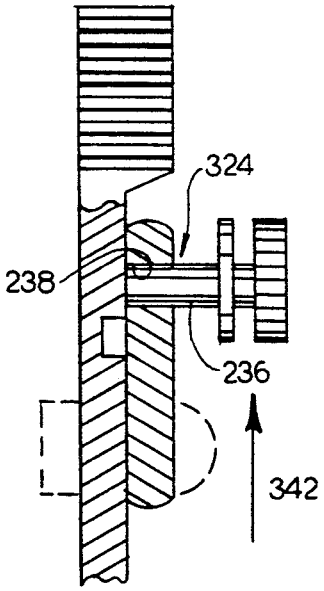
FIG. 10
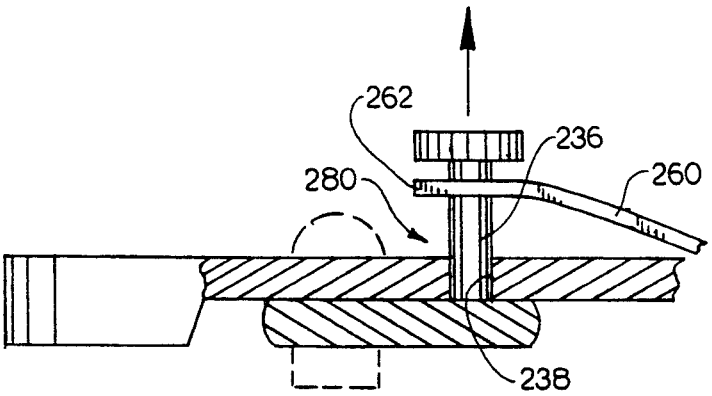
FIG. 11

COMBINATION HAND TOOL WITH SPRING-LOADED LOCKING DEVICE

This application relates to a hand tool and more particularly to a combination hand tool of the pliers type having a further tooltip at the end of each arm of the handle of the pliers with a spring-loaded locking device for locking the pliers in an open position to provide a handle from one arm of the pliers for tool mounted at the tip of the other arm, in conjunction with providing a nail pulling capability.

BACKGROUND OF THE INVENTION

Pliers generally have two arm elements pivotally connected at a slip joint. Each arm has a handle at one end and a jaw at the other end. The slip joint serves to expand or contract the size of the jaw opening and the resultant gripping capability of the pliers as required. Two types of pliers are typical, being commonly referred to as crescent pliers or slip pliers. Crescent pliers are also known as arc pliers.

It is highly desirable to provide combination tools. However, use of combination tools can result in a complicated set up which destroys the efficiency of the tool involved. Also, it is highly desirable for a compound tool to be easily used with other components and easily transferred from the use of one element of the compound tool to another element, while at the same retaining the effectiveness of the individual tool.

Furthermore, there is great difficulty in having the elements locked into position for efficient use of each element of the compound tool. If the locking cannot be accomplished efficiently, the tool lacks the required effectiveness.

The locking devices of the prior art are cumbersome. There is often difficulty in operating the locking device while in the act of using the pliers as a screwdriver. U.S. Pat. No. 4,920,593, by the same inventor, addresses these issues and is incorporated herein by reference.

If these factors can be accomplished efficiently, the advantages of having a compound tool are equivalent to providing each tool individually while retaining the advantages of having more than one tool available immediately.

Also desirable is to have a multi-faceted pair of pliers. If the pliers type tool can conserve the pliers function, while, at the same time, being modifiable in a simple fashion for other types of tools, greater advantages are obtained for the field of combination hand tools.

SUMMARY OF THE INVENTION

Accordingly, among the many objects of this invention is to provide a hand tool in the form of a pair of pliers capable of being fixed in position so that a tool at the tip on the end of one handle arm of the pliers may be used efficiently.

A further objective of this invention is to provide a pair of pliers capable of pulling nails.

A still further objective of this invention is to provide a pair of pliers having a screwdriver tip at the end of a handle arm.

Yet a further objective of this invention is to provide a pair of pliers having a phillips screwdriver tip at one end of a handle arm.

Another objective of this invention is to provide a pair of pliers having a flat blade screwdriver tip at one end of a handle arm.

Yet another objective of this invention is to provide a pair of pliers having a locking mechanism to fix the handle arms of the pliers in an open position.

Still another objective of this invention is to provide a pair of pliers having a spring-loaded, locking mechanism to fix the handle of the pliers, which is simple to use.

Also an objective of this invention is to provide a pair of pliers having a variable tool at one end of a handle arm.

These and other objectives of this invention are met by providing a pair of pliers with a tool mounted to each arm end, such as, for example, a screwdriver tip at one end of each handle, a nail puller in the jaws of the pliers and a spring-loaded, slip joint-activated locking mechanism to hold the jaws in a predetermined position by operation of the slip joint, with an optional socket receiving tip on the pliers.

BRIEF DESCRIPTION OF THE DRAWINGS

FIG. 8 is a partial, cutaway, side view of FIG. 5 showing locking movement 323 by locking direction arrow 340.

FIG. 9 is a partial, cutaway, side view of FIG. 5 showing engaged position 290.

FIG. 10 is a partial, cutaway, side view of FIG. 5 showing unlocking movement 324 by unlocking direction arrow 342.

FIG. 11 is a partial, cutaway, side view of FIG. 5 showing disengaged position 280.

Throughout the Figures of the drawing, where the same part appears in more than one Figure of the drawing, the same number is applied thereto.

DESCRIPTION OF THE PREFERRED EMBODIMENTS

A pliers having a screwdriver tip or other tool at the end of each handle and a spring-loaded, locking mechanism activated by the slip joint for positioning the handle arms at a substantially ninety (90°) degree angle from each other. In this fashion, one handle arm of the pliers can become a handle arm for operating the tool, while the other handle arm serves as the tool. The spring-loaded, locking mechanism is activated by movement of the pivotal slip joint.

The tool may be a screwdriver such as a flat bladed screwdriver, a phillips screwdriver, a star screwdriver or any other suitable screwdriver. The tool handle arm may be adapted to receive a changeable tool of the socket type. Similar structures in the embodiments to be disclosed are numbered similarly, with the prefix number being changed relative to the particular embodiment being described.

Figure 1:
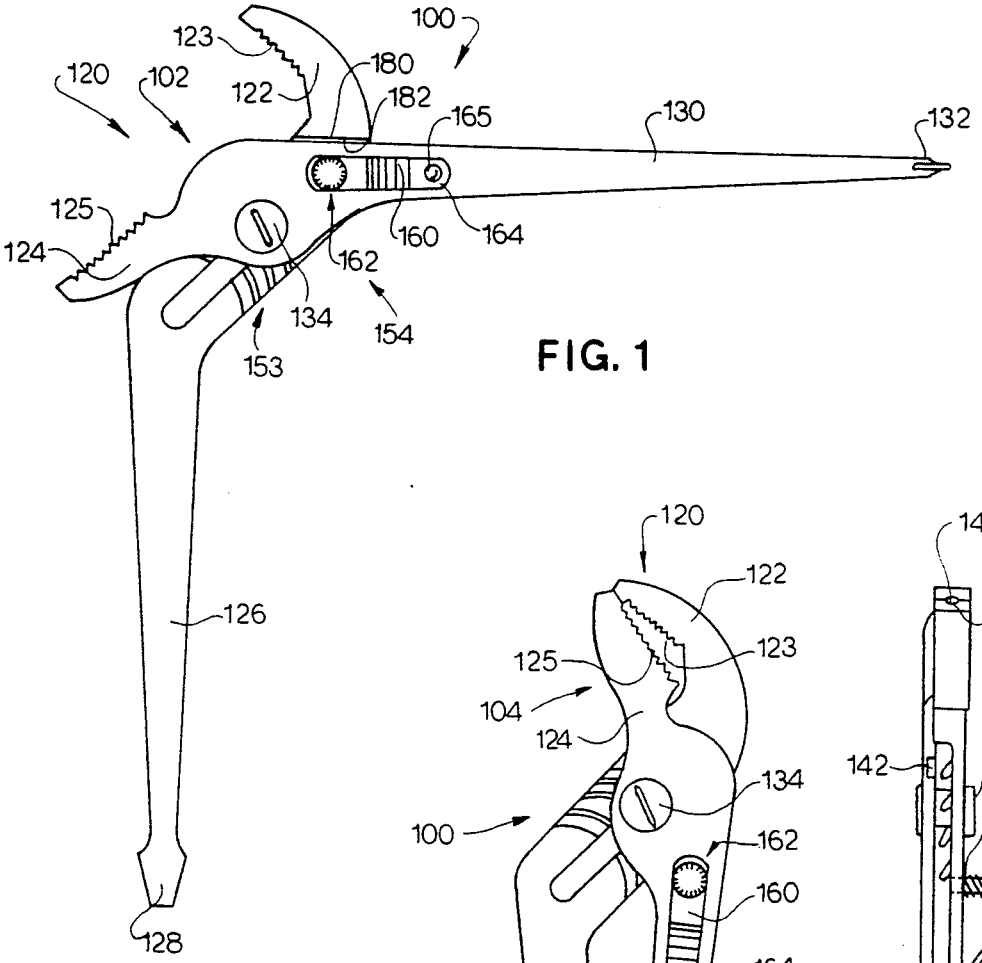
FIG. 1 is a front view of crescent (also known as arc joint) pliers 100 in open position 102, having a phillips screwdriver tip 132 and a flat screwdriver tip 128 thereon.
Figure 3:
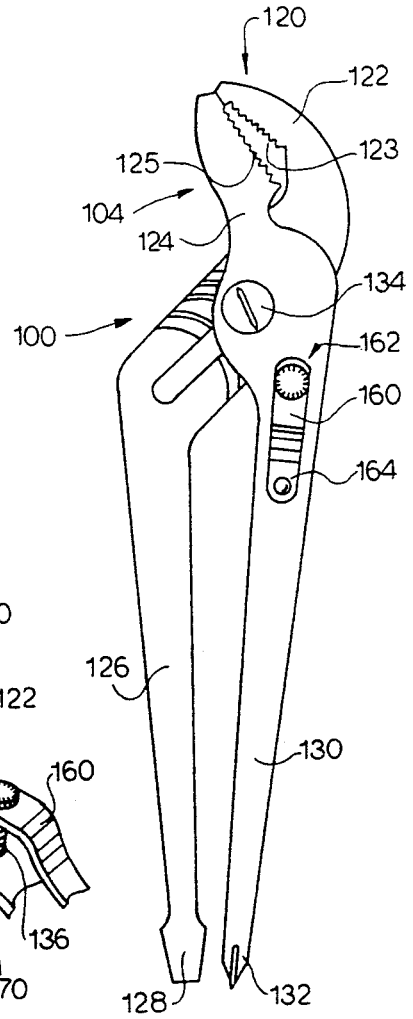
FIG. 3 is a front view of crescent pliers 100 in closed position 104.

Referring now to FIG. 1 and FIG. 3, the crescent pliers 100 include a standard slide angle jaw 120 having a first jaw side 122 and a second jaw side 124 for the purpose of gripping a desired element therebetween. Crescent pliers 100 are also known as arc pliers. First jaw side 122 includes a first jaw gripper 123, and extends into a first handle arm 126. First jaw gripper 123 is thus at one end of first handle arm 126; while, at the other end of the first handle arm 126, is a flat blade screwdriver 128.

By the same token, second jaw side 124 extends from a second jaw gripper 125 into a second handle arm 130. Second jaw gripper 125 is thus at one end of second handle arm 130 while, at the other end of the second handle arm 130 is a phillips screwdriver 132. Second jaw gripper 125 and first jaw gripper 123 serve to grip a desired item therebetween.

Figure 2:
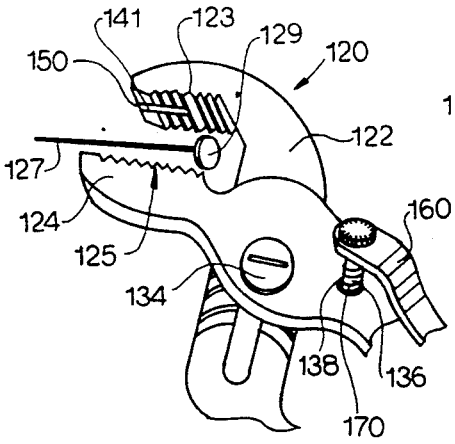
FIG. 2 is a perspective view of crescent jaws 120 for crescent plier 100 showing nail puller 150 thereof.
Figure 4:
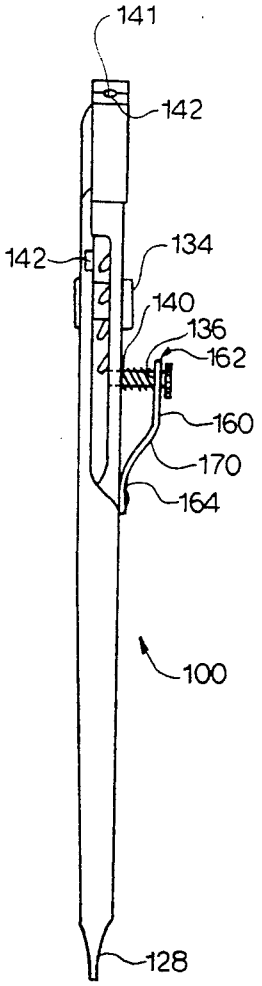
FIG. 4 is a side view of the pliers 100 of FIG. 3.

Referring to FIG. 2 and FIG. 4, situated on second jaw 124 adjacent crescent pivot 134 is a locking pin 136 secured thereto. The locking pin 136 is spring loaded and moves downwardly to contact first jaw side 122, when activated by opening the first handle arm 126 and second handle arm 130 to about a 90° angle and moving them relative to pivot pin 134. Such movement is done in order to lock the crescent pliers 100 in appropriate position to use either flat blade screwdriver 128 or phillips screwdriver 132 or another optional tool, as is described hereinafter.

The locking pin 136 is slidably mounted in locking pin aperture 138 in second jaw side 124. Locking pin 136 has an aperture end 140 situated in said locking pin aperture 138, which moves downwardly to contact first jaw side 122 and be received by locking pin pit 142 in first jaw side 122, when second jaw side 124 is separated from first jaw side 122 and slipped thereover around pivot point 134 in order to lock the crescent pliers 100 in appropriate position to use either flat blade screwdriver 128 phillips screwdriver 132, or any alternative tool mounted at the end second handle arm 130 or first handle arm 126. Locking is achieved as crescent slip joint 153 is moved to lock position 154.

The locking pin 136 is held as slidably mounted in locking pin aperture 138 by bar spring 160. Bar spring 160 has a pin end 162 secured to locking pin 136 and an oppositely disposed arm end 164 secured to second jaw side 130. Such securing is in any standard fashion such as by bolting or welding at 165.

In this fashion, the desired results can be achieved of providing a method of positioning the crescent pliers 100 so that either the flat blade screwdriver 128 or phillips screwdriver 132 may be used.

Still considering FIG. 2 and FIG. 4, the crescent pliers 100 include a nail puller 150 having a first jaw slot 141 in first jaw gripper 123 and second jaw slot 142 in second jaw gripper 125. First jaw slot 141 and second jaw slot 142 can abut to grip therebeteen a nail 127 or other item desired to be removed from a board or for similar gripping purposes. First jaw slot 141 and second jaw slot 142, when abutting, can receive nail 127 with a nail head 129 resting between the first jaw gripper 123 and second jaw gripper 125. The slot formed by abutment of first jaw slot 141 and second jaw slot 142 is long enough to accomplish that grip. This slot structure is applicable to slip pliers 200 also.

The coil spring 170 is shown as being suitable for holding locking pin 136 or locking rod 236 (FIGS. 5 to 11) in position in combination with the crescent bar spring 160 or slip bar spring 260 (FIGS. 5 to 11). It is, of course, possible to use coil spring 170 or 270 and the bar spring 160 or 260 together or separately.

Slip bar spring 260 (shown in FIG. 5) may also be used in combination with coil spring 270. Coil spring 270 is welded or otherwise secured to both locking rod 236 and locking rod aperture 238 to hold and provide the locking means. The locking rod 236 passes through locking rod aperture 238 in second jaw side 224 into locking rod pit 242 (shown in dashed lines in FIG. 4) situated on first jaw side 222.

Figure 5:
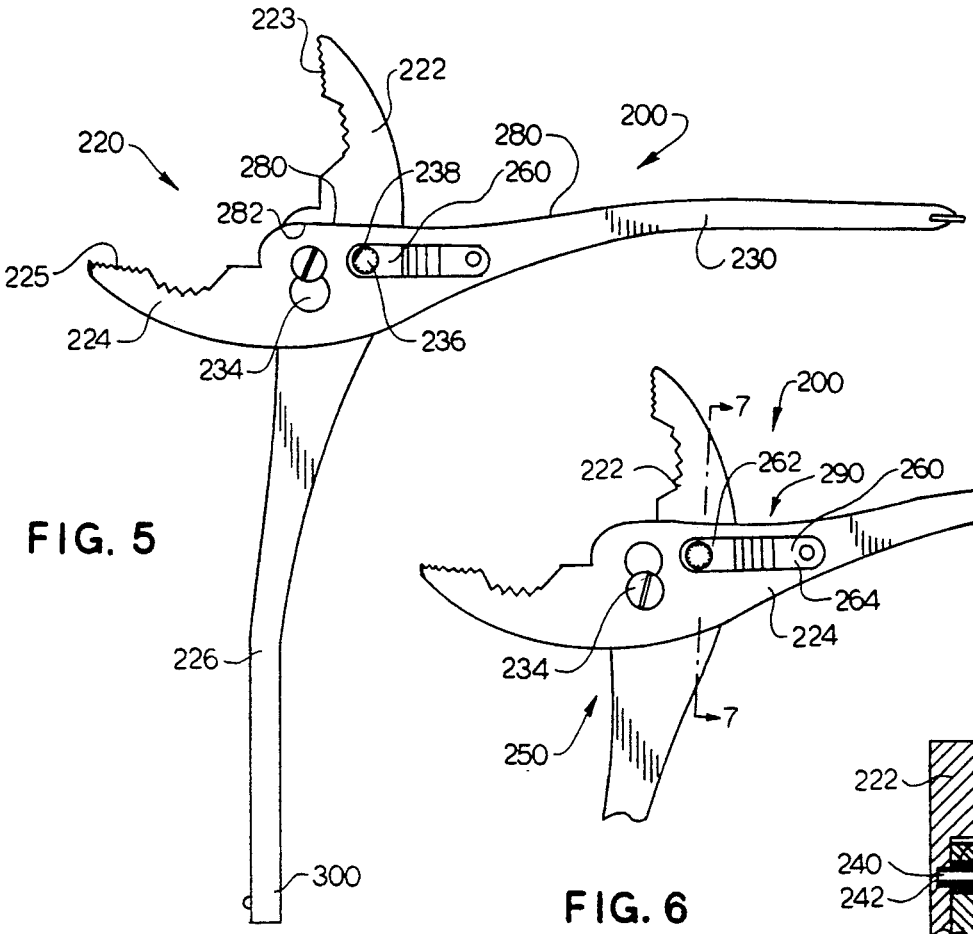
FIG. 5 is a front view of slip pliers 200 in engaged position 290.
Figure 6:
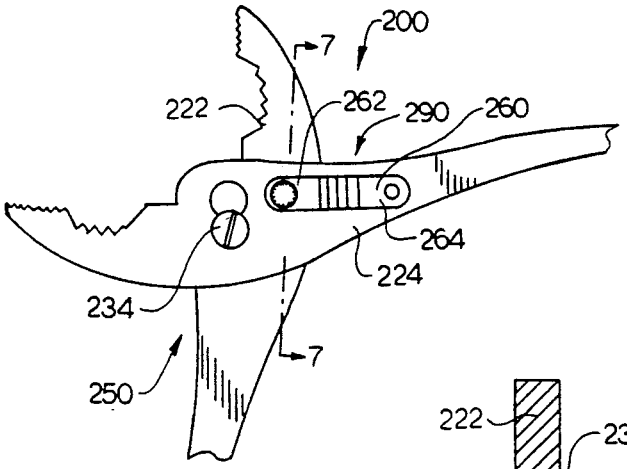
FIG. 6 is a front view of slip pliers 200 in disengaged position 280.
Figure 7:
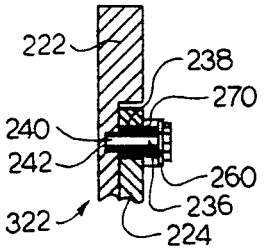
FIG. 7 is a cross-section of FIG. 6 along Line 7—7 modified to show a coil spring 270 as a loading device for locking rod 236, with locking rod 236 in engaged position 322.

Referring now to FIG. 5 and FIG. 6, the slip joint pliers 200 include a standard slip jaw 220 having a first slip side 222 and a second slip side 224 for the purpose of gripping a desired element therebetween. First slip side 222 includes a first slip gripper 223 and extends into a first slip handle arm 226. First slip gripper 223 is thus at one end of first slip arm 226; while at the other end of the first handle arm 226 is a variable arm tip 300 (.shown in FIG. 12).

By the same token, second slip side 224 includes a second slip gripper 225 and extends into a second slip handle arm 230. Second slip gripper 225 is thus at one end of second slip arm 230 while, at the other end of the second slip arm 226 is a phillips screwdriver 232. Second slip gripper 225 and first slip gripper 223 serve to grip desired items thherebetween.

Situated on second slip arm 230 adjacent slip joint pivot 234 is a locking rod 236 secured thereto. The locking rod 236 is slidably mounted in locking rod aperture 238. Locking rod 236 has an aperture end 240 (FIG. 7) received in said locking rod aperture 238, which moves downwardly to contact first slipside 222 and is received by locking rod pit 242 in the same when second slip position 250 is achieved in order to lock the slip joint pliers 200 in appropriate position to use either variable handle arm 300 or phillips screwdriver 232. Locking is achieved so that either second slip handle arm 230 and variable handle tip 300 on arm 226 can be used alternatively as a tool or a handle for the tool mounted on the opposite handle end.

The locking rod 236 is held as slidably mounted in locking rod aperture 238 by slip bar spring 260. Slip bar spring 260 has a rod end 262 secured to arm 230. Such securing is in any standard fashion such as by bolting or welding.

The first jaw slot 140 and second jaw slot 142 of FIG. 2 and FIG. 4 may also be in slip joint pliers 200 for similar purposes. Locking pin 136 and locking rod 236 are similar in purpose and function, with the differing names and numbers used to distinguish between crescent pliers 100 and slip pliers 200.

With consideration of FIG. 1, FIG. 8, FIG. 9, FIG. 10, and FIG. 11, the support for locking rod 236 is shown. First jaw side 122 includes a first jaw brace 180. Second jaw side 124 includes a second jaw brace 182. First jaw brace 180 is between first jaw gripper 123 and first handle arm 126. Second jaw brace 182 is between second jaw gripper 125 and second handle arm 130. When first jaw brace 180 and second jaw brace 182 abut, first handle arm 126 and second handle arm 130 are substantially perpendicular to each other for the use of either tool.

Locking rod 236 locks slip pliers 200 in that open position. Locking rod 236 is shown as spring loaded in FIG. 7 with coil spring 270. An exterior spring such as crescent bar spring 160 is also an operable structure for spring loading locking rod 236. Additionally, coil spring 270 and crescent bar spring 260 may be used in combination or separately.

In FIG. 5, FIG. 8, and FIG. 9, the engaged position 280 of locking rod 236 is shown. Locking pin 136 has a similar position in an engaged position. Likewise, FIG. 6, FIG. 10, and FIG. 11 combine to show the disengaged position 323 of locking rod 236. Locking pin 136 has a similar appearance, when in a similar position. With consideration of FIG. 5, FIG. 7, FIG. 8, FIG. 9, FIG. 10, and FIG. 11, the support for locking rod 236 shown is also applicable to slip joint pliers 200.

Figure 12:
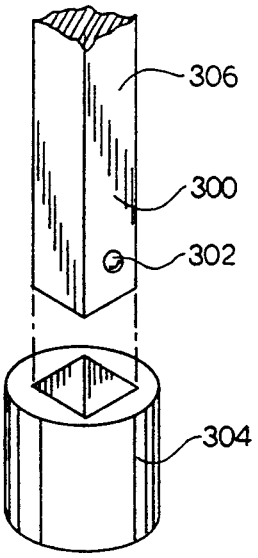
FIG. 12 is a perspective view of handle arm end 300 with a socket receiver 302 thereon.

In FIG. 12, a sample of variable tip 300 is shown. As can be seen, variable tip 300 has a springloaded ball 302. The variable tip 300 is shaped to receive a socket 304. Clearly, the socket 304 can be of any type such as a socket screwdriver, a nut turning socket, or similar device. With this socket 304 fitting on one or both handle arms of the pliers, the pliers can be accomodated to achieve any type of tool as desired.

Variable tip 300 is preferably square in cross-section nature with a spring loaded ball 302 mounted in one side 306 of plier handle arm 300. The spring loaded ball 302 serves to lock socket 304 or other desired tools in place. In this fashion, either crescent pliers 100 or slip joint pliers 200 can be modified to incorporate variable tip 300 and act as a lever with a wide variety of uses. In other words, variable handle tip 300 can be incorporated on at least one of first handle arm 126, second handle arm 130, first slip handle arm 226, and second slip handle arm 230 to achieve the desired flexibility.

Figure 13:
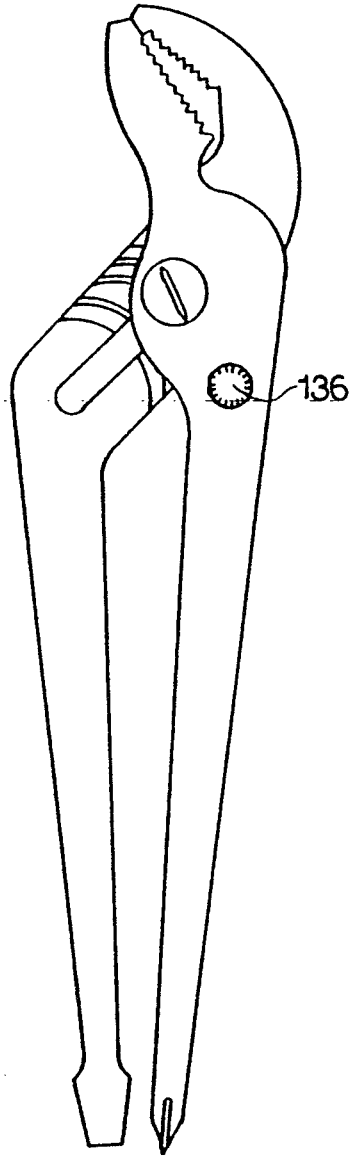
FIG. 13 depicts a front view of a coil spring 170 as a loading device for locking pin 136.
Figure 14:
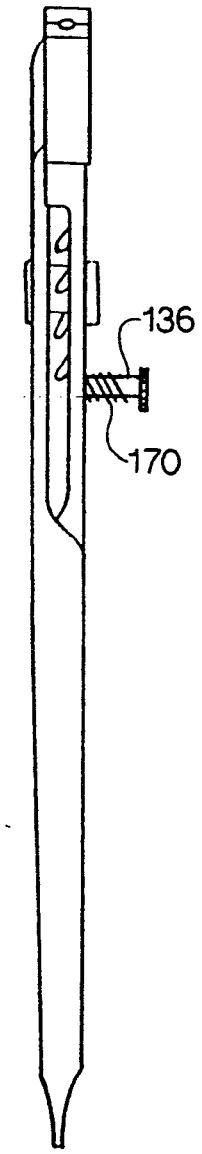
FIG. 14 depicts a side view of a coil spring 170 as a loading device for locking pin 136.

With consideration of FIG. 13 and FIG. 14, it becomes clear that coil spring 170 can be used alone without slip bar spring 260 or crescent bar spring 160. This is especially true of lighter duty pliers, although the spring combination is highly desired for the heavy duty pliers. While only crescent pliers 100 are specifically shown, it is clear that these teachings provide for application to slip joint pliers 200 also.

This application—taken as a whole with the specification, claims, drawings, and abstract,—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of the disclosure herein and solely because of the disclosure herein, certain modifications of the pliers disclosed herein can become clear to a person having ordinary skill in this art. Such modifications are clearly covered hereby.

What is claimed and sought to be secured by Letters Patent of the United States, is:

1. A combination handtool having a pliers function, and a variable tool function in one tool, wherein:

a. said hand tool includes a spring-loaded locking mechanism to assist said variable tool function;

b. said pliers function is accomplished by providing a pliers having a first handle arm and a second handle arm;

c. said spring-loaded locking mechanism permits said first handle arm to act as a first handle for a second tool at a second handle arm end of said second handle arm;

d. said spring-loaded locking mechanism permits said second handle arm to act as a second handle for a first tool at a first handle arm end of said first handle arm;

e. said first tool is selected from the group consisting of a first fixed tool and a first variable tool;

f. said second tool is selected from the group consisting of a second fixed tool and a second variable tool;

g. said second handle arm end includes a second releasable securing means for said second variable tool;

h. said first handle arm end includes a first releasable securing means for said first variable tool;

i. said spring-loaded locking mechanism is operated by a bar spring;

j. said spring-loaded locking mechanism further includes a locking pin slideably connected to said second handle arm by said bar spring;

k. a pin receiving means is situated in said first handle arm to removably receive said locking pin;

l. said pivotal connecting means includes a slip joint;

m. said slip joint activates said spring-loaded locking mechanism;

o. said bar spring has a pin end secured to said locking pin;

p. said bar spring has an arm end secured to said second handle arm;

q. said pin end is oppositely from said arm end;

r. said first releaseable securing means for said first variable tool includes a springloaded ball adjacent to said first handle end, whereby said first handle end is adapted to receive a first socket; and s. said second releasable securing means for said second variable tool includes a springloaded ball adjacent to said second handle end, whereby said second handle end is adapted to receive a second socket.

2. The combination handtool of claim 1 wherein:

a. said combination handtool further includes a nail pulling function; and b. said nail pulling function in situated in said first jaw end and said second jaw end.

3. The combination handtool of claim 1 wherein:

a. said receiving means is an indentation within said first handle arm; and b. said pin is received within said indentation.

4. The combination handtool of claim 3 wherein said pliers function is accomplished by a slip pliers.

5. The combination handtool of claim 3 wherein said pliers function is accomplished by a crescent pliers.

6. A combination handtool having a pliers function, and a variable tool function in one tool, wherein:

a. said hand tool includes a spring-loaded locking mechanism to assist said variable tool function;

b. said pliers function is accomplished by providing a pliers having a first handle arm and a second handle arm;

c. said spring-loaded locking mechanism permits said first handle arm to act as a first handle for a second tool at a second handle arm end of said second handle arm;

d. said spring-loaded locking mechanism permits said second handle arm to act as a second handle for a first tool at a first handle arm end of said first handle arm;

e. said first handle arm includes a first jaw end oppositely disposed from said first handle arm end;

f. said second handle arm includes a second jaw end oppositely disposed from said second handle arm end;

g. a pivotal connecting means joins said first handle arm and said second handle arm in a pivotal relationship;

h. said pivotal connecting means is situated between said first jaw end and second handle arm end;

i. said pivoted connecting means is situated between said first jaw end and first handle arm end;

j. said spring-loaded locking mechanism is situated adjacent to said pivotal connecting means;

k. said spring-loaded locking mechanism is operated by a bar spring;

l. said spring-loaded locking mechanism further includes a locking pin slideably connected to said second handle arm by said bar spring.

m. a pin receiving means is situated in said first handle arm to removably receive said locking pin;

n. said pivotal connecting means includes a slip joint;

o. said slip joint activates said spring-loaded locking mechanism;

p. said bar spring has a pin end secured to said locking pin;

q. said bar spring has an arm end secured to said second handle arm;

r. said pin end is oppositely from said arm end;

s. said first releaseable securing means for said first variable tool includes a springloaded ball adjacent to said first handle end, whereby said first handle end is adapted to receive a first socket; and t. said second releasable securing means for said second variable tool includes a springloaded ball adjacent to said second handle end, whereby said second handle end is adapted to receive a second socket.

7. The combination handtool of claim 6 wherein:

a. said first tool is selected from the group consisting of a first fixed tool and a first variable tool;

b. said second tool is selected from the group consisting of a second fixed tool and a second variable tool; and c. said second handle arm end includes a second releasable securing means for said second variable tool;

h. said first handle arm end includes a first releasable securing means for said first variable tool.

8. The combination handtool of claim 7 wherein:

a. said combination handtool further includes a nail pulling function; and b. said nail pulling function in situated in said first jaw end and said second jaw end.

9. The combination handtool of claim 7 wherein:

a. said receiving means is an indentation within said first handle arm; and b. said pin is received within said indentation.

10. The combination handtool of claim 7 wherein said pliers function is accomplished by a slip pliers.

11. The combination handtool of claim 7 wherein said pliers function is accomplished by a crescent pliers.

* * * * *